US005695254A

United States Patent [19]

Shinners et al.

[11] Patent Number: 5,695,254

[45] Date of Patent: Dec. 9, 1997

[54] METHOD AND APPARATUS FOR BREAKING CONCRETE OR THE LIKE

[75] Inventors: George F. Shinners; John L. Talbert, both of Antigo, Wis.

[73] Assignee: Badger State Highway Equipment, Inc., Antigo, Wis.

[21] Appl. No.: 731,974

[22] Filed: Oct. 23, 1996

Related U.S. Application Data

[60] Provisional application No. 60/006,191 Nov. 11, 1995.

[51] Int. Cl.[6] ..... B25D 9/00; E01C 23/12

[52] U.S. Cl. ..... 299/37.3; 173/101

[58] Field of Search ..... 299/37.3, 37.4, 299/100; 173/90, 101; 404/90

[56] References Cited

U.S. PATENT DOCUMENTS

| | | | |
|---|---|---|---|
| 13,055 | 12/1855 | Craig | 299/37.3 X |
| 2,350,223 | 5/1944 | Gedge | 173/101 X |
| 2,425,018 | 8/1947 | Williams | 299/37.4 |
| 2,903,949 | 9/1959 | Simmonds | 173/194 |
| 3,172,483 | 3/1965 | Spitzer | 173/195 |
| 3,400,771 | 9/1968 | Dorn | 173/195 |
| 3,509,723 | 5/1970 | Dorn | 60/413 |
| 3,904,245 | 9/1975 | Clarke | 299/37.4 |
| 4,402,629 | 9/1983 | Gurries | 404/90 |
| 4,439,056 | 3/1984 | Reilly et al. | 404/90 |
| 4,453,773 | 6/1984 | Toffolon | 299/37.1 |
| 4,457,645 | 7/1984 | Klochko | 299/37.3 |
| 4,511,282 | 4/1985 | Gurries | 404/90 |
| 4,515,408 | 5/1985 | Gurries | 299/37.2 |
| 4,634,311 | 1/1987 | Jinnings et al. | 404/90 |
| 4,984,639 | 1/1991 | Lindsey et al. | 173/100 |
| 5,490,740 | 2/1996 | Johnson | 299/37.4 |

FOREIGN PATENT DOCUMENTS

| | | | |
|---|---|---|---|
| 986315 | 3/1965 | United Kingdom | 299/37.3 |
| 1420432 | 1/1976 | United Kingdom | 404/90 |

*Primary Examiner*—David J. Bagnell
*Attorney, Agent, or Firm*—Dorsey & Whitney LLP

[57] ABSTRACT

A substrate breaking apparatus and method including a frame and a plurality of independently controlled hammers movable between a lowered position and a raised position.

21 Claims, 8 Drawing Sheets

METHOD AND APPARATUS FOR BREAKING CONCRETE OR THE LIKE

This application claims the benefit of Provisional Application Ser. No. 06/006,191 filed Nov. 1, 1995.

BACKGROUND OF THE INVENTION

1. Field of the Invention

The present invention relates generally to a method and apparatus for breaking concrete or the like, and more particularly, to a multi-head concrete breaker for cracking, breaking or rubblizing the concrete in existing roadways or other surfaces for removal or for asphalt overlay.

2. Description of the Prior Art

As highway and roadway systems mature, highway programs change from new construction to rehabilitation and maintenance. A common technique for rehabilitation of concrete pavement, in contrast to new construction, is to overlay existing roadways with hot mix asphalt. One problem with this technique, however, is a condition referred to as reflective cracking. Reflective cracking is the propagation of existing cracks and joints in the underlying concrete or pavement upwardly through the overlaid asphalt or other layer.

Various techniques have been developed to overcome this problem. One involves use of wire mesh or other reinforcing material in combination with specific formulations of the overlaid asphalt mix. A second involves cracking the underlying pavement into smaller segments and then rolling the segments with a roller to seat the concrete pieces into the subgrade prior to overlaying the same with an asphalt mix.

A still further technique is to break the existing concrete into still smaller pieces which is often referred to as "rubblizing". Rubblizing is a type of concrete demolition in which the demolished pavement and broken pieces are not substantially displaced, but are broken into pieces which are usually no greater than approximately one to two inches in diameter at the surface and eight inches in the lower layer. When reinforced pavement is rubblized, the broken pieces are substantially debonded from any reinforcement located therein. Rubblized concrete may be rolled and compacted as a base for newly poured concrete or asphalt layers or can be removed. A principal advantage of rubblizing concrete is that it provides greater flexibility to the structure and eliminates distinct edges at joints and cracks, thus minimizing reflective cracking or other deterioration of the overlaid material.

Various equipment has been developed for breaking concrete pavement in preparation for removal or asphalt overlay. Examples include those disclosed in U.S. Pat. No. 4,402,629 issued to Gurries, U.S. Pat. No. 4,439,056 issued to Riley et al., U.S. Pat. No. 4,457,645 issued to Klochko and U.S. Pat. No. 4,634,311 issued to Jinnings et al. Other machines have included concrete breakers having a single, relatively large hammer or head, sometimes as much as eight feet wide and weighing several tons. One disadvantage of machines of this sort is that, because of their size and weight, they have a tendency to push the pavement down into the substrate as it is broken. Although these machines are generally acceptable for cracking, their use for rubblizing is extremely limited.

Development has occurred with respect to concrete breaking machines having one or more hammers and utilizing a cantilevered, whip arm principle. These machines claim to have the ability to rubblize concrete, however, they have not been particularly effective due to poor mechanical design.

A machine currently available for rubblizing is a machine known in the trade as a "resonant breaker". Such machine has a single head about 6–7 inches wide projecting from the front of the machine at its midpoint and thus breaks concrete in strips about 6–7 inches wide. Thus, it breaks the roadway concrete in longitudinal strips and necessarily requires numerous passes to cover the roadway width. Several limitations exist with this machine. First, it often leaves areas of unbroken concrete between the broken strips. Secondly, because the vehicle is much wider than the 6–7 inch head, several feet of clearance are required on each side of the broken strip. Thirdly, because of the relatively high wheel load and because at least two of the wheels must traverse broken concrete, the machine can sometimes sink into the concrete which is already broken and damage the underlying substrate and/or pavement strata.

Accordingly, there is a need for an improved method and apparatus for breaking concrete and the like which overcomes the limitations of the prior art.

SUMMARY OF THE INVENTION

In contrast to the prior art, the present invention relates to a method and apparatus for breaking concrete which overcomes the deficiencies of the prior art and facilitates the performance of all pavement breaking techniques including the cracking of pavement prior to an asphalt overlay, the breaking of pavement for removal or the rubblizing of pavement for removal or for asphalt or concrete overlay.

In general, the apparatus of the present invention includes a multi-head or multi-hammer concrete breaker having one or more hammer pairs or hammer assemblies in which the operation cycle for each hammer assembly is independently controlled. By using multiple hammers or heads with staggered operation cycles, or with operation cycles which are initially the same but which become staggered during use, significantly smaller hammers can be utilized and an irregular striking pattern can be achieved. This allows the apparatus to spread out the relatively low impact force levels of the smaller hammers and thus eliminate or substantially reduce vibration concerns without sacrificing, and often improving, performance.

Further, in the apparatus of the present invention, the plurality of hammers are mounted transversely, across the machine, to permit the apparatus to break concrete across its entire width, which can extend 8–12 feet or more. This eliminates the strips of unbroken concrete often present when using the "resonant breaker" machine of the prior art. Such structure also substantially eliminates any side-by-side clearance restrictions and enables the apparatus to function without requiring the vehicle to be supported by broken concrete.

More specifically, the concrete breaking apparatus of the present invention includes a frame or chassis assembly adapted for carrying a plurality of hammer assemblies whose break cycle (lift and drop cycle) is controlled independently of other hammer assemblies. In the preferred embodiment, each hammer assembly comprises a pair of hammers spaced transversely across the machine from one another. Each hammer is guided for generally vertical up and down movement along a pair of guide members fixed to the frame. Each pair of hammers is associated with an actuating or lift cylinder which functions to raise the hammers to a desired height and then allows the same to drop by gravity as part of the operation or breaking cycle. Preferably the cylinder is positioned between the pair of hammers and is operatively connected to the hammers through a yoke and connection means which facilitates relative movement between the hammers and thus limited tilting movement of the yoke.

Associated with each of the lift cylinders is a hydraulic system comprising a source of fluid pressure to lift the hammers to their desired height and to release the hammers for free fall by gravity toward the pavement at a particular time in the cycle. The hydraulic system is in turn controlled by an electronic control which controls the entire breaking (lift/drop) cycle including the time at which the hammers are lifted, the time during which the hammers are lifted and thus the height to which the hammers are lifted, and the time at which the hammers are dropped. The apparatus of the preferred embodiment of the present invention is capable of operating at up to 40 cycles per minute. In the preferred embodiment, the apparatus is attached to a towing vehicle at its forward end and is provided with support wheels at its rearward end.

The method aspect of the present invention includes providing a plurality of hammers in the form of one or more hammer assemblies or pairs and operating the break cycles of such hammer assemblies independently of one another.

Accordingly, an object of the present invention is to provide a method and apparatus for breaking concrete or the like which overcome limitations of prior machines in the art and which can perform all desired concrete breaking functions.

Another object of the present invention is to provide an improved method and apparatus for breaking concrete or the like which includes multiple breaking heads whose breaking cycles are controlled or operated independently of one another.

Another object of the present invention is to provide a concrete breaker having one or more hammer assemblies in which each hammer assembly includes a pair of spaced hammers and a single lift mechanism associated therewith including a lift cylinder and a yoke member.

A still further object of the present invention is to provide a multi-hammer concrete breaking method and apparatus in which each hammer or group of hammers is independently controlled or operated.

These and other objects of the present invention will become apparent with reference to the drawings, the description of the preferred embodiment and the appended claims.

DESCRIPTION OF THE PREFERRED EMBODIMENT AND METHOD

The method and apparatus of the present invention relates to a device commonly referred to as a concrete breaker. Although its primary use is in connection with the cracking, breaking or rubblizing of concrete highways and roadways for subsequent removal or asphalt overlay, it is not intended that the method and apparatus be limited to such use. For example, the method and apparatus of the present invention can be used in connection with the cracking, breaking and rubblizing of concrete other than highways or roadways. It is intended that the method and apparatus of the present invention can be used for cracking, breaking or rubblizing materials other than concrete such as asphalt substrates. Further, the preferred embodiment is described with reference to a hydraulic system for driving the lift cylinders, however, it is to be understood that other sources of fluid pressure such as a pneumatic pressure source may be used as well. It is also to be understood that many of the features of the present invention can be achieved via a lift mechanism other than a fluid power lift mechanism, such as a mechanical lift mechanism.

Figure 1:
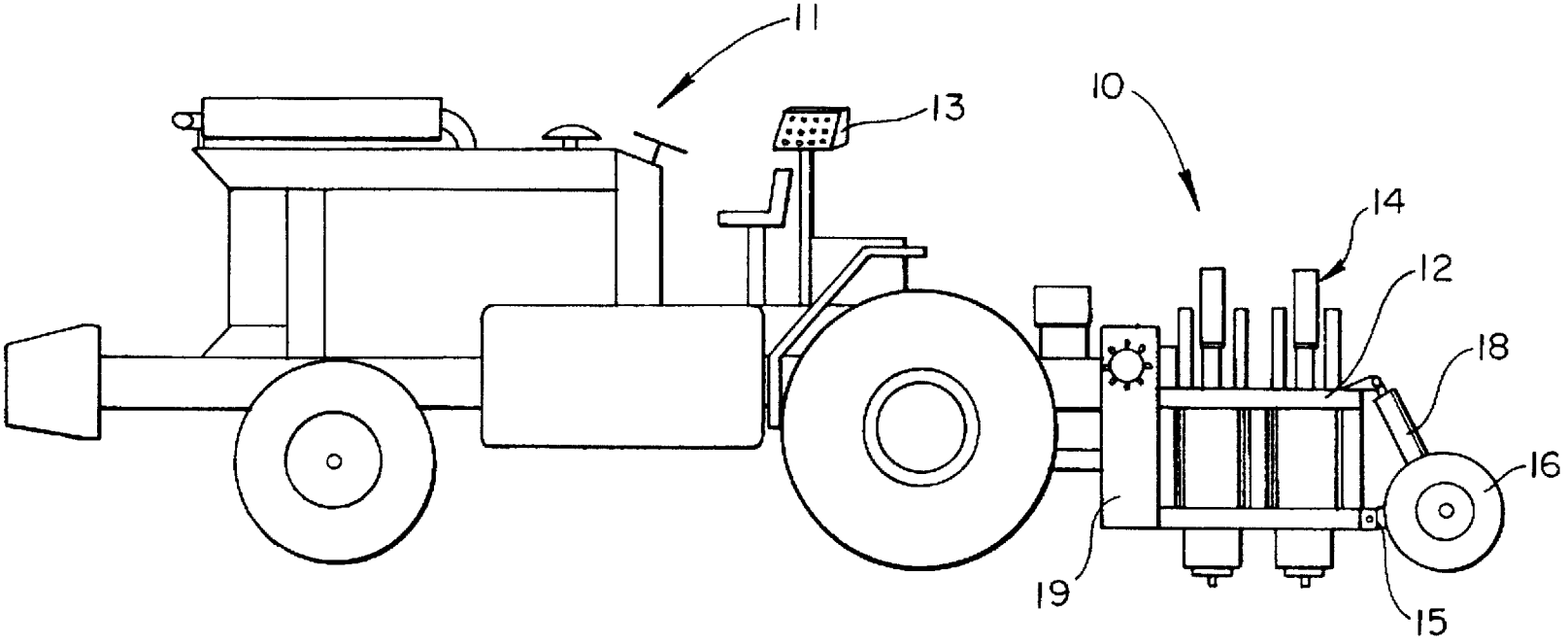
FIG. 1 is an elevational side view of the concrete breaking apparatus of the present invention connected with a towing vehicle.
Figure 2:
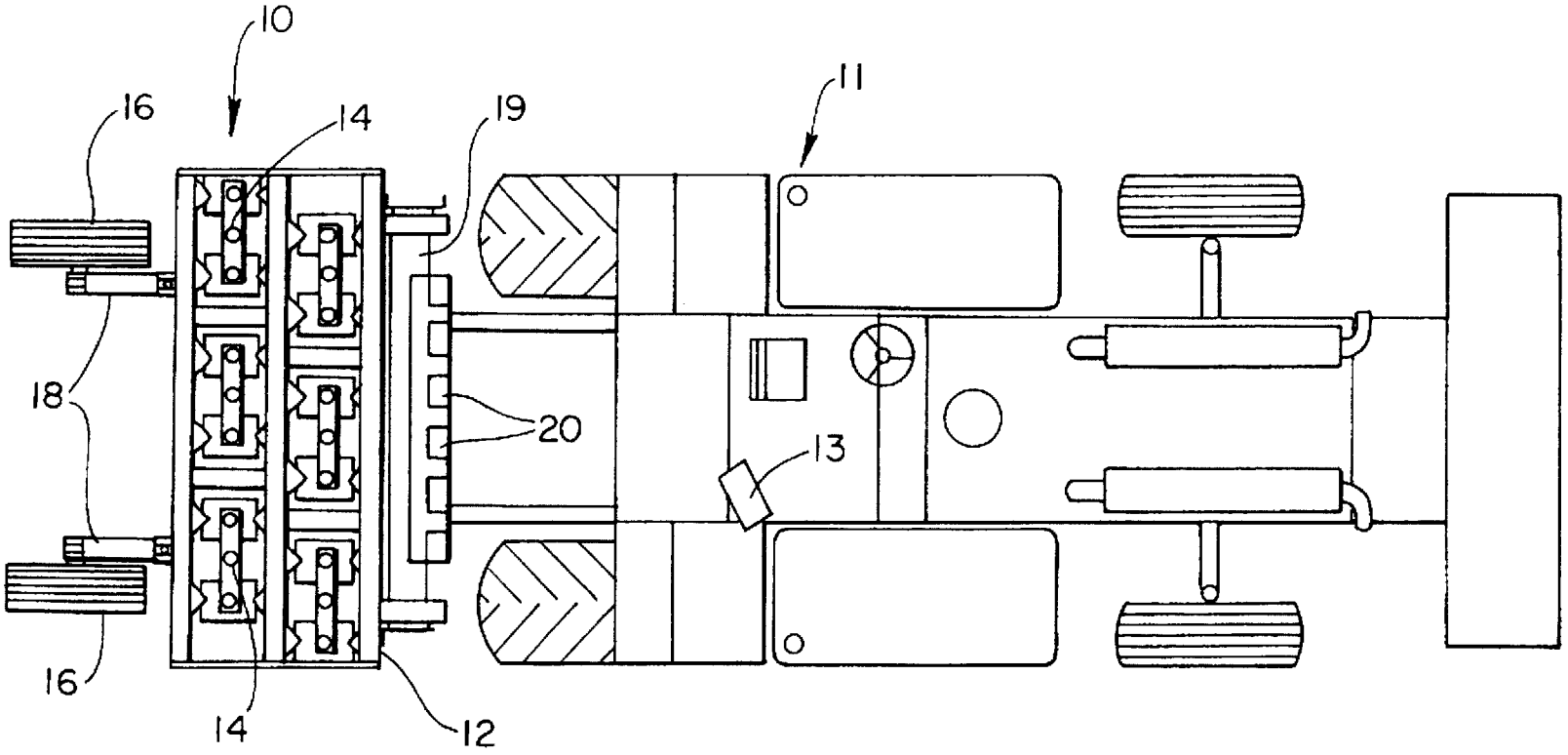
FIG. 2 is an elevational plan view of the apparatus of the present invention and towing vehicle as shown in FIG. 1.

Reference is first made to FIGS. 1 and 2 in which the concrete breaker apparatus 10 is shown as being connected with a towing vehicle 11. The vehicle 11 may be a wheeled vehicle as shown or an endless track vehicle, if desired. Although it is possible for the apparatus 10 of the preferred embodiment to be designed as an attachment to a tractor or other vehicle, it is intended that the apparatus would normally be connected to a dedicated vehicle designed only for use with the apparatus of the present invention. Such vehicle should preferably have multiple (at least three) output shafts for driving the hydraulic pumps and be capable of very slow, consistent and accurate travel speed on the order of 36 inches per minute or less.

The apparatus 10 includes a frame assembly 12 and a plurality of head or hammer assemblies 14 operatively mounted to the frame assembly 12. The preferred embodiment includes three rearwardly positioned hammer assemblies positioned in transversely or laterally spaced relationship in a rearward portion of the frame 12 and three forwardly positioned hammer assemblies positioned in transversely or laterally spaced relationship in a forward portion of the frame 12. As shown best in FIG. 2, the forward and rearward hammer assemblies are staggered across the width of the apparatus 10 so that a slab of concrete the width of the apparatus 10 can be cracked or rubblized in one travel pass.

The forward end of the apparatus 10 includes means 19 for connection with the towing vehicle 11 and plurality of hydraulic distribution units 20 for lifting and dropping the plurality of hammer assemblies in accordance with predetermined cycle parameters as will be described below. A control box 13 is connected with the vehicle 11. The rearward end of the apparatus 10 is provided with a pair of wheel supports 15 and a pair of wheels 16. Preferably the wheel supports 15 are pivotally secured to a rearward portion of the frame assembly 12 and a piston/cylinder assembly 18 extends between an upper portion of the frame assembly 12 and the outer end of the wheel support 15 for adjusting the height of the frame 12 relative to the wheels 16 and thus the ground level.

Figure 3:
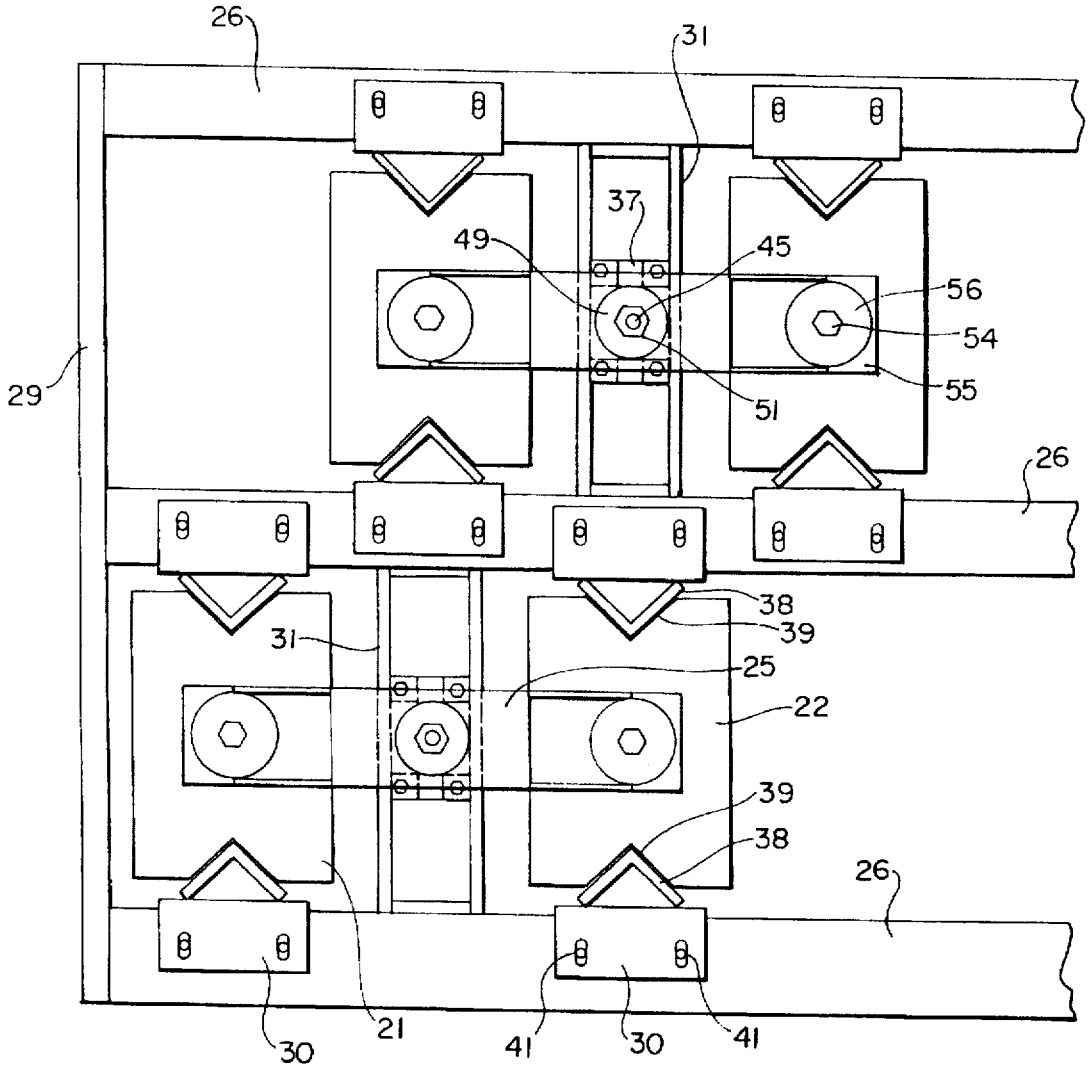
FIG. 3 is an elevational plan view of two of the hammer assemblies of the apparatus of the present invention.
Figure 4:
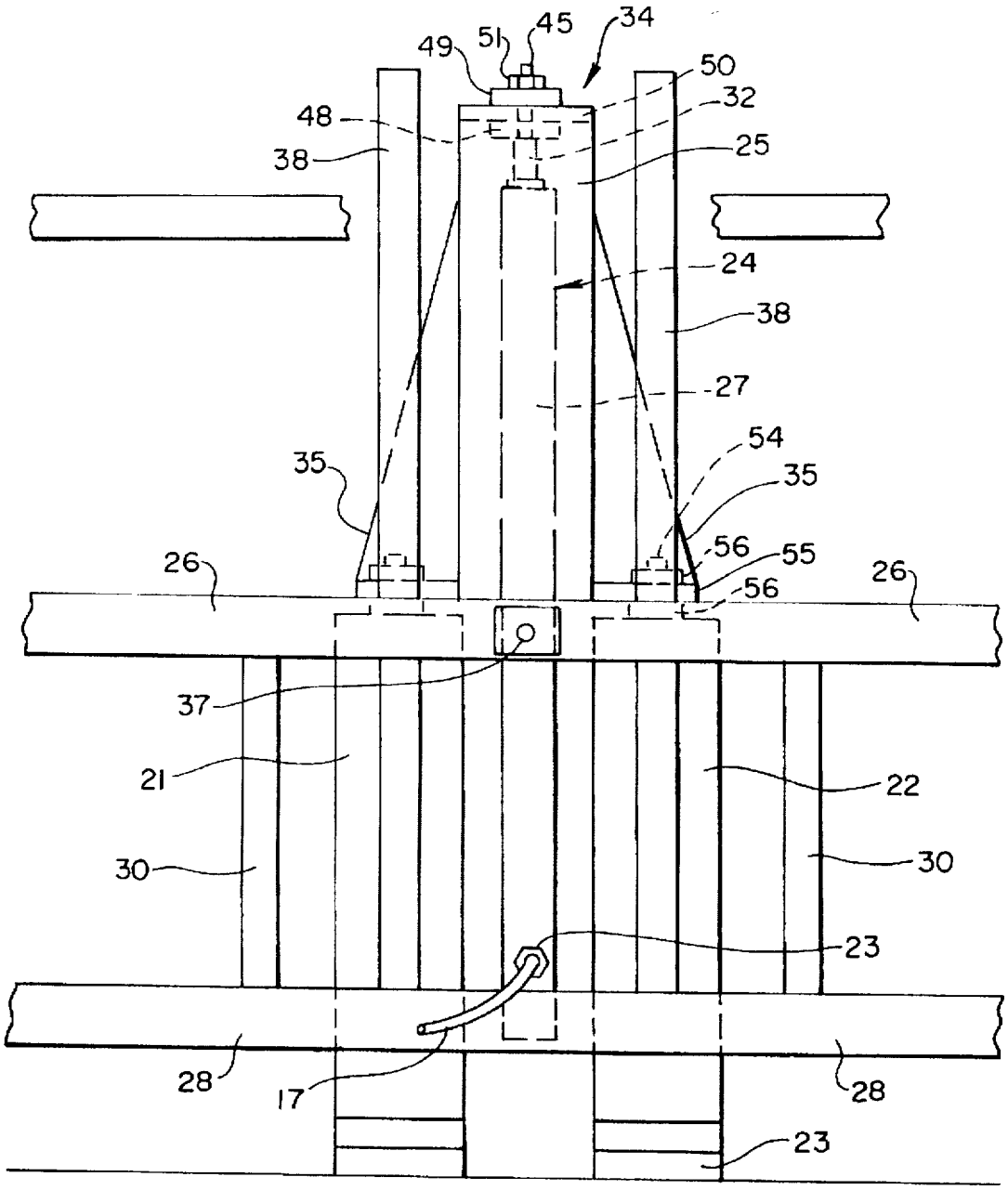
FIG. 4 is an enlarged elevational front view of one of the hammer assemblies of the present invention.

The frame assembly illustrated in FIGS. 1 and 2 by the general reference character 12 is shown in FIGS. 3 and 4 as including a plurality of upper, lower, side and intermediate frame members. The upper frame members 26 and the tower frames members 28 are interconnected by a plurality of side frame members 29 and intermediate vertical frame members 33 (FIG. 4). As illustrated best in FIG. 3, the upper frame is shown as comprised of three frame members 26 extending across the width of the apparatus and connected in fixed relationship to similar lower frame members 28 by a plurality of side and intermediate frame members 29 and 33.

With continuing reference to FIGS. 3 and 4, each hammer assembly includes a pair of hammers 21 and 22, a lift cylinder 24 and a tower or yoke member 25 connecting the lift cylinder 24 with each of the hammers 21 and 22. The lift cylinder 24 of each of the hammer assemblies 14 is connected with and carried by the frame assembly 12 by means of a cross support brace 31 extending between adjacent frame members 26 as shown best in FIGS. 3 and 4. Each cross brace 31 is connected with the lift cylinder 24 by a trunion mount for supporting the cylinder and thus the yoke 25 and the pair of hammers 21 and 22 as well. The trunion mount includes a pivot 37 connected with the brace 31 and the cylinder 24 enabling the cylinder to accommodate limited relative movement between the hammers 21 and 22 and to permit limited side-to-side tilting movement of the cylinder 24. The lift cylinder assembly 24 includes an hydraulic cylinder 27 with a fluid power/exhaust port 23 at its lower end. The port 23 function to provide a source of fluid power to, and to exhaust fluid from, the interior of the cylinder 27. A piston rod 32 extends outwardly from the cylinder 27 and is connected to the yoke 25 by an appropriate connection means 34.

In the preferred embodiment, the piston rod 32 includes a connection end 45 with a diameter smaller than the diameter of the piston rod 32, a pair of donut-shaped members 48 and 49 positioned on opposite sides of a top mount plate 50 of the yoke 25 and a nut 51 threaded onto the externally threaded connection end 45. Preferably, a pair of steel washers are also provided on opposite sides of the donut members 48 and 49 and a brass bushing is positioned between the connection end 45 and the top 50.

The yoke 25 includes a pair of outwardly extending wings or connection members 35 for connection with the top end of each of the weights or hammers 21 and 22. The connection between the outer ends of the wings 35 and the hammers 21 and 22 provide for limited relative movement between such elements to accommodate slight tilting movement of the yoke 25 caused by one of the hammers dropping further than the other. As illustrated best in FIGS. 3 and 4, the connection means 36 includes a threaded member 54 extending upwardly from each of the hammers 21 and 22 through an opening in a lower hammer mount plate 55 of each wing 35. The connection means 36 further includes a pair or donut-shaped rubber mounts 56, 56 positioned on opposite sides of the mount plate 55.

Figure 7:
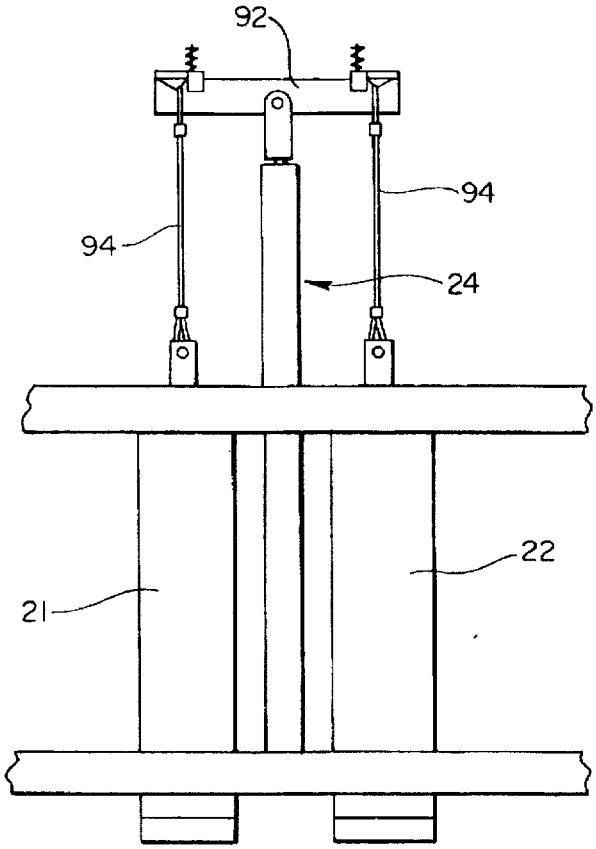
FIG. 7 is an elevational front view of one of the hammer assemblies showing an alternate embodiment for connecting the hammers to the lift cylinder assembly.

FIG. 7 is an alternate embodiment of a connection means to interconnect the cylinder assembly 24 with the hammers 21 and 22. In FIG. 7, the connection means includes a lift bar 92 connected with the top end of the piston rod 32 and a pair of cables 94, 94 connecting the outer ends of the lift bar 92 with the hammers 21 and 22. The lift bar 92, as shown, is pivotally connected to the piston rod to facilitate tilting of the bar caused by the hammers 21 and 22 being lifted to different heights. Other connection means may also be provided including various lost motion types of connections.

Each of the hammers 21 and 22 is guided by a pair of angle iron guide members 38, 38 which are positioned on opposite sides of the hammer and which extend generally vertically long the entire travel path of the hammers 21 and 22. As illustrated best in FIG. 3, each cooperating pair of angle guides 38 include an angled comer surface facing toward each other and designed to cooperate in sliding relationship with a pair of corresponding angled grooves 39 in each of the hammers 21 and 22. Each of the guides 38 may be rigidly secured to a guide mounting bracket 30 which is in turn connected to the upper and lower frame members by a plurality of threaded members 41 or other connecting means. The connection between the bracket 30 and the frame members allows some adjustability of the bracket position relative to the frame members so that the position of the guides 38 can also be adjusted. However, the guides 38 can be welded or otherwise connected directly to the frames 26 and 28. Additional frame members and support can also be provided for the guides 38 if desired.

As shown best in FIG. 4, the bottom end of each of the hammers 21 and 22 is provided with a striking bar 43. The striking bar has a bottom edge for striking the concrete or the material to be broken. The configuration of the bottom edge can be whatever is desired. Preferably the bottom edge has a rectangular cross sectional configuration. The striking bar is preferably connected with the hammer 21 or 22 in a manner which allows the orientation of the striking bar 23 to be adjusted. In the preferred embodiment, a steel plate is secured to the bottom of each of the hammers 21 and 22 by threaded members or the like and the striking bar is welded to the bottom of the steel plate. The striking bar may be positioned transversely so that it extends laterally relative to the apparatus, diagonally or in line with the movement of the apparatus. When positioned in line with the movement of the apparatus, the concrete will tend to be broken into strips.

Figure 5:
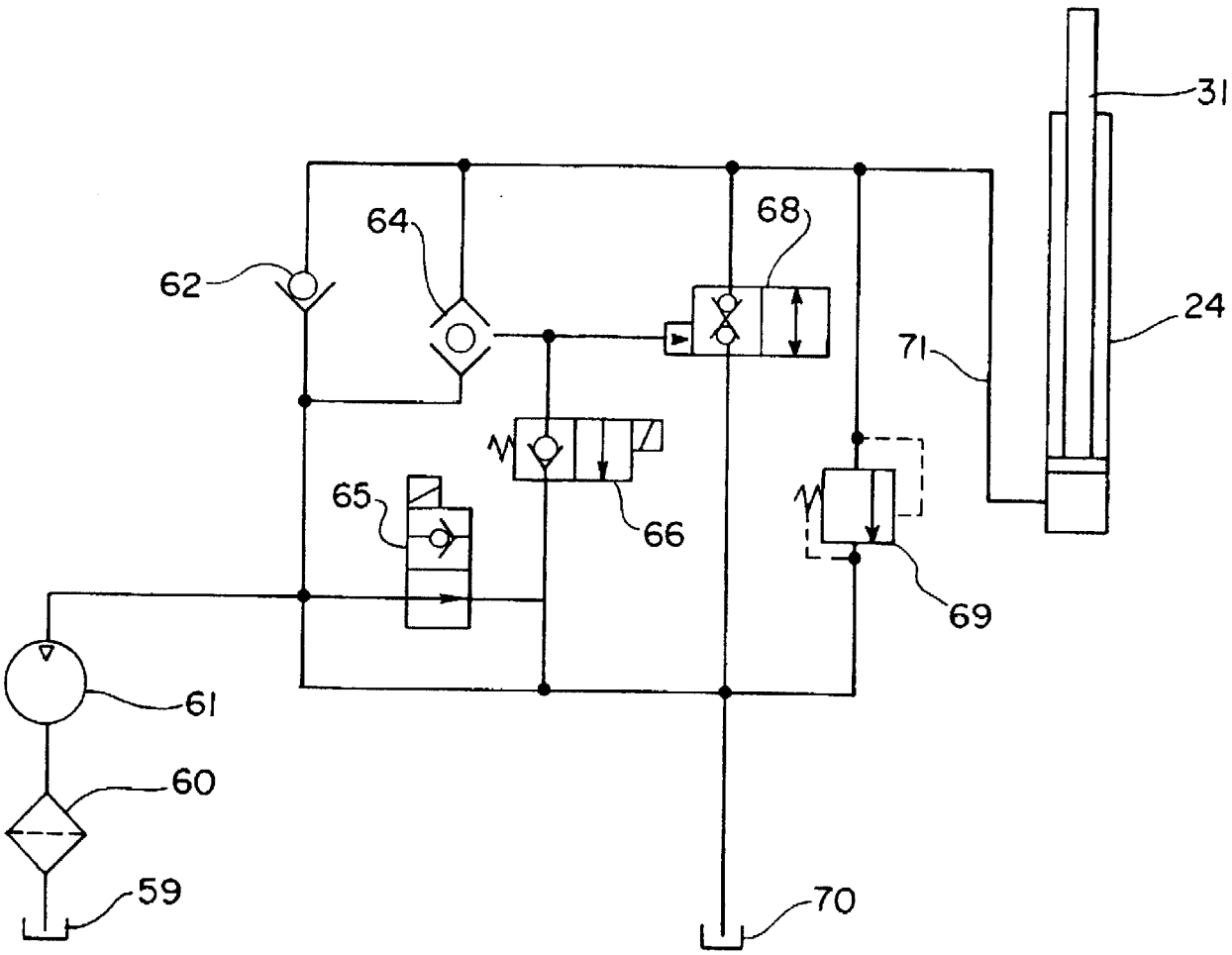
FIG. 5 is a schematic of the hydraulic circuit associated with each of the lift cylinders.

The supply of fluid power to, and the exhaust of fluid from, each lift cylinder 24 via the port 23 is controlled by an hydraulic distribution unit 20 which is schematically illustrated in FIG. 5. The operation of each hydraulic unit 20, in turn is controlled by an electronic control mechanism which is schematically illustrated in FIG. 6.

The hydraulic distribution system illustrated by the hydraulic schematic of FIG. 5 is provided with each of the hammer assemblies and thus each of the lift cylinders 24. The hydraulic schematic includes a source of hydraulic fluid 59, a filter 60 and an hydraulic pump 61. The supply of pressurized hydraulic fluid from the pump 61 to the cylinder 24 is controlled by the lifting valve 65. The lifting valve 65 is normally open which allows the fluid to flow through the valve 65 and to a fluid reservoir or sump 70. When the lifting valve 65 is closed, hydraulic pressure flows through a check valve 62 and into the cylinder through the line 71. When the piston 32 within the cylinder 24 has reached the desired height, the lifting valve 65 is opened, thus preventing further supply of fluid pressure to the cylinder 24. If the systems is in a jog mode, the valve 65 will remain open and the piston 32 will remain in its lifted position.

If the system is in a normal operation cycle, opening of the valve 65 will also result in opening of a pilot valve 66. The pilot valve 66 is normally in a closed position and when in such closed position holds pressure on a drop valve 68 to maintain the drop valve 68 in a closed position as well. When pressure in the pilot valve 66 is lowered, the drop valve 68 is allowed to open, thus exhausting fluid from within the cylinder 24 to the sump 70. The valve 68 is sufficiently large to permit the hammers connected with the rod 32 to essentially free fall by gravity, causing fluid within the cylinder 24 to be exhausted through the valve 68 in the process. A relief valve 69 is provided to direct pressurized fluid to the sump 70 if the pressure within the system exceeds a predetermined level. In the event the operator desires to lift the piston, and thus the hammers and to maintain the same in a lifted position such as in the jog mode, the pilot valve 66 can be maintained in its closed position.

Figure 6:
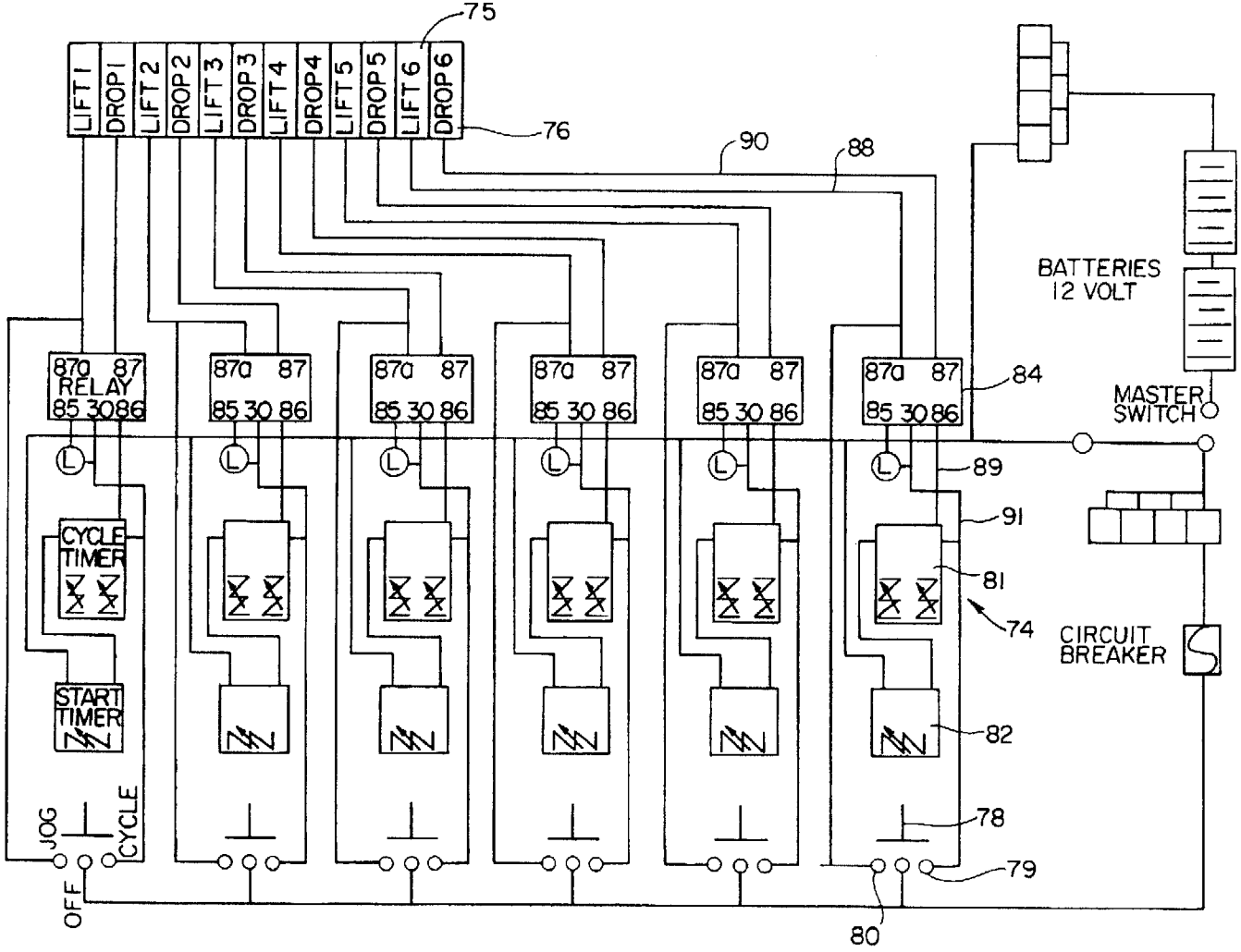
FIG. 6 is a schematic of the electronic control for the apparatus of the present invention.

Reference is next made to FIG. 6 illustrating the control box schematic for controlling the hydraulic distribution units associated with each of the hammer assemblies. As shown, FIG. 6 discloses an identical timer circuit 74 associated with each of the hydraulic distribution units. Specifically, the outputs from each timer circuit 74, namely the lift output 75 and the drop output 76 control the lifting valve 65 and the pilot valve 66, respectively, of the hydraulic circuit of FIG. 5.

Each timer circuit includes a switch 78 which can be switched either to a cycle mode 79 or a jog mode 80. When switched to a cycle mode 79, the timer circuit 74 functions to start the timer to begin the lift cycle at a preset time, to lift the cylinder and thus the hammer assembly for a preselected time (and thus to a predetermined height), to drop the hammer assembly and to then repeat the cycle again repeatedly. When the switch is switched to the jog mode 80, the cylinder 24 and thus the associated hammer assembly are lifted to a desired height and retained in that position.

Each timer circuit includes a cycle timer 81, a start timer 82 and a solenoid relay 84. When the switch 78 is switched to the cycle mode 79, the cycle timer 81 is energized. This results in the commencement of a lift/drop cycle. Initially, at a preset time following activation of the cycle timer, the lifting valve 65 (FIG. 5) will be closed as a result of a signal from the cycle timer 81 via the output 75 (FIG. 6). Such signal is provided via the line 89, through the relay 84 via the contacts 86 and **87*a* and then to the output 75. When the lift portion of the cycle is completed, the signal from the cycle timer 81 is de-energized. This results in the relay 84 switching from contact 87*a* to contact 87, thus resulting in the lift valve returning to its normal open position and the pilot valve 66 being opened via the signal at the output 76 via the lines 90 and 88 and through the contacts 87 and 87*a* of the relay 84. The cycle timer includes input means by which the initiation of the lift cycle, the lift cycle duration (and thus the lift height) and the drop time can be set and predetermined. The drop time is the time period between the opening of the lift valve 65 and the pilot valve 66 to drop the hammer and the start of the lift cycle by closing the valve 65**.

Thus, when the cycle switch 79 is turned on, the following occurs:

1. The hammers drop;
2. The start timer begins to time out adjustable preset time before the cycle begins;
3. The cycle timer starts, closing the relay, sending electric power to the hydraulic lift valve 65 causing the hammers to be lifted to the height determined by time duration of the adjustable lift timer;
4. The lift timer stops and the drop timer starts, opening the relay, sending electric power to the valve 66 causing the hammers to drop for time duration of adjustable drop timer;
5. The lift cycle starts and cycling repeats until cycle switch is turned off.

With the control mechanism and hydraulic system illustrated in FIGS. 5 and 6, the lift and drop cycle of each hammer assembly can be controlled or operated independent of one another. For example, it might be desirable to lift some hammers higher than the others to break thicker concrete such as at the edges of a roadway. Each cycle includes variables relating to the period of time during which the hammers are lifted and thus the height to which the hammers are lifted and the time at which the hammers are dropped. The fully raised height of the hammers is about 40 inches. The drop time may also be controlled. By coordinating the lift and drop cycles for each of the plurality of hammer assemblies, or by providing random lift and drop patterns, the impact forces of the hammers can be spread out, thus substantially reducing, if not eliminating vibration concerns. Further, because multiple hammers and multiple hammer assemblies are utilized, each hammer can be substantially reduced in size without sacrificing overall machine performance. It should also be understood that the cycle speed and other parameters are to be coordinated with the travel speed of the towing vehicle 11 so that the desired degree of cracking or rubblizing may be achieved.

Figure 8:
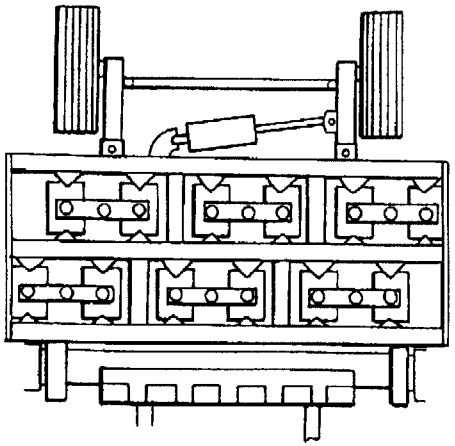
FIG. 8 is an elevational plan view of a further embodiment showing the concrete braking apparatus with steerable wheels.

A further embodiment of the apparatus of the present invention is illustrated in FIGS. 8–12. FIG. 8 shows an embodiment of the invention in which the support wheels 16 are steerable. This is accomplished via a piston/cylinder assembly 95 positioned between a rearward portion of the apparatus and one of the wheel support members 96 which are in turn pivotally connected to the apparatus frame 12. A tie rod 98 extends between the wheel support members 96,96.

Figure 9:
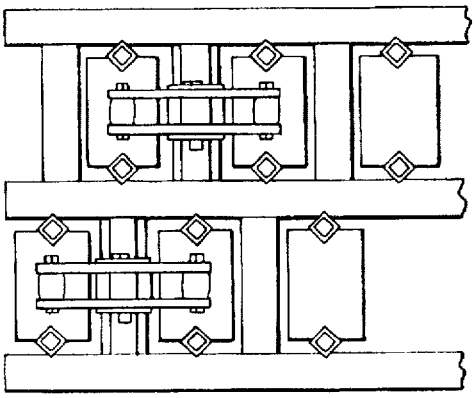
FIG. 9 is an elevational plan view, similar to that of FIG. 3, showing a further embodiment of a hammer lifting mechanism.
Figure 10:
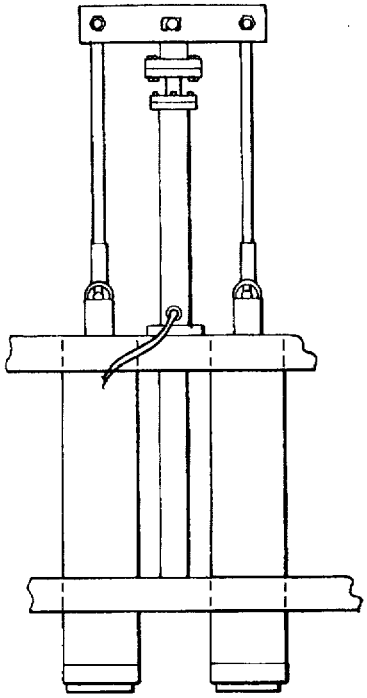
FIG. 10 is an elevational front view showing the further embodiment of FIG. 9 with the hammers in down position.
Figure 11:
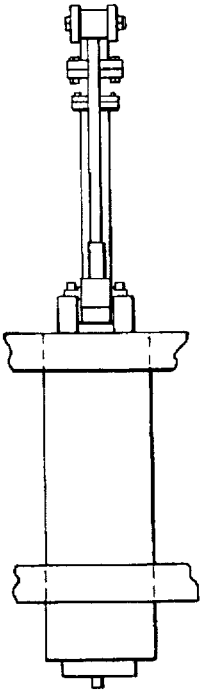
FIG. 11 is an elevational side view of the hammer assembly and lifting mechanism of FIG. 10.
Figure 12:
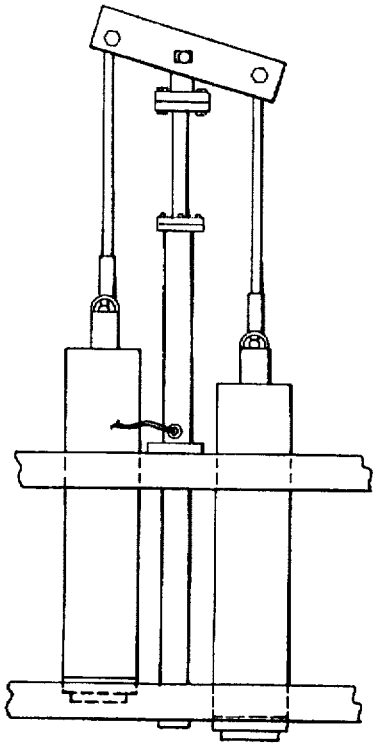
FIG. 12 is an elevational front view of the embodiment of FIG. 10, with the hammers in a partially raised position.

FIGS. 9–11 illustrate top, front and side elevational views of a further embodiment of the means for transferring the lifting force from the lift cylinder 24 the hammers 21 and 22. As shown, the top end of the piston rod 32 is pivotally connected with a pair of spaced cross arms 99,99 by a pair of plates 100, a support post 101 and a transversely extending pin or bolt 102 extending between the cross-arms 99,99. The outward ends of each of the cross-arms 99,99 is provided with means in the form of the bolts 104 and 105 and corresponding rubber bushings 106 and 108 for pivotally connecting the outer ends of the cross-arms 99,99 to a pair of torque arms or rods 109 and 110. The bottom ends of the torque arms 109 and 110 are pivotally connected with the top ends of the hammers 21 and 22, respectively, by a hammer connection assembly. In the embodiment of FIGS. 9–11, the hammer connection assembly includes a pair of support posts 111,111 connected with the top of each hammer, a rubber bushing 112 and a support pin 115 extending outwardly from the bottom end of each torque arm 109 and 110 for pivotal connection with the support As shown in FIG. 12, this structure enables the hammers 21 and 22 to be lifted to different heights and thus to drop to different levels as well. During operation, one hammer may fall to a different level because of uneven terrain or the existence of a raised portion in the concrete, etc. When this occurs, the hammers may be raised to different heights as shown in FIG. 12. However, during the next cycle, the hammers will be lifted to approximately the same height unless the condition which caused their unevenness continues to exist.

In the embodiment of FIGS. 9–12, the hammer guides 116 are generally square tubes which are welded to the various frame members such as the frame members 26 as illustrated in FIG. 9. It should also be noted that in the embodiment of FIGS. 9–12, the lift cylinder 24 is connected with the frame members 26 via the support block 118 and the fluid port 23 is positioned approximately at the mid-point of the cylinder 24.

Although the description of the present invention has been quite specific, it is contemplated that various modifications could be made without deviating from the spirit of the present invention. Accordingly, it is intended that the scope of the present invention be dictated by the appended claims rather than by the description of the preferred embodiment and method.

I claim:

1. A substrate breaking apparatus comprising:

a frame;

a plurality of hammer assemblies operatively connected with said frame, each said hammer assembly including at least two hammers moveable between a raised position and a lowered position;

an independently controlled fluid operated lift mechanism operatively connected with each of said plurality of hammer assemblies;

a source of fluid pressure; and an independent control operatively connected with each lift mechanism, each said control including an adjustable first input means for controlling the flow of fluid pressure to said lift mechanism and an adjustable second input means for controlling the exhaustion of fluid from said lift mechanism.

2. The substrate breaking apparatus of claim 1 wherein said lift mechanism includes a lift means for moving said hammers in unison from said lowered position to said raised position and dropping said hammers in unison for movement of said hammers from said raised position to said lowered position.

3. The substrate breaking apparatus of claim 1 wherein each of said lift mechanisms includes a lift cylinder.

4. The substrate breaking apparatus of claim 1 wherein said at least two hammers comprise a pair of spaced hammers and said lift mechanism is positioned between said hammers.

5. The substrate breaking apparatus of claim 1 including hammer guides between said frame and said hammers.

6. The substrate breaking apparatus of claim 1 and a second hammer assembly offset forwardly and laterally from said at least one hammer assembly.

7. The substrate breaking apparatus of claim 1 wherein said first input means includes a first timer.

8. The substrate breaking apparatus of claim 7 wherein said second input means includes a second timer.

9. A substrate breaking apparatus comprising:

a frame;

at least one hammer assembly operatively connected with said frame, said hammer assembly including at least two hammers moveable between a raised position and a lowered position; and a lift mechanism including a lift means operatively connected with said two hammers for moving said hammers in unison from said lowered position to said raised position and dropping said hammers in unison for movement of said hammers from said raised position to said lowered position, wherein said lift means includes a lift cylinder.

10. The substrate breaking apparatus of claim 9 wherein said lift means includes a yoke connected with said lift cylinder at a cylinder connection point and connected with said hammers at a point on opposite sides of said cylinder connection point.

11. The substrate breaking apparatus of claim 9 wherein said lift means includes a cross arm connected with said lift cylinder at a connection point and a cable member extending from each of said hammers and connected to said cross-arm at positions on opposite sides of said connection point.

12. The substrate breaking apparatus of claim 9 wherein said lift means includes a cross arm operatively connected with said lift cylinder at a connection point and a rigid rod extending from each of said hammers and connected to said cross arm at positions on opposite sides of said connection point.

13. A substrate breaking apparatus comprising:

a frame;

a plurality of hammers operatively connected with said frame, each of said hammers moveable between a raised position and a lowered position, said plurality of hammers including a first set of hammers each laterally spaced from an adjacent hammer in said first set and a second set of hammers each laterally spaced from an adjacent hammer in said second set, said second set being spaced forwardly of, and offset laterally from, said first set, wherein at least one of the hammers in said second set is positioned laterally between two adjacent hammers in said first set; and lift mechanisms associated with said plurality of hammers.

14. The substrate breaking apparatus of claim 13 wherein said plurality of hammers are laterally positioned relative to one another to define a substrate breaking width and wherein said frame is supported by ground engaging means positioned within said substrate breaking width.

15. The substrate breaking apparatus of claim 13 wherein said lift mechanism includes a lift means for moving said hammers from said lowered position to said raised position.

16. A substrate breaking apparatus comprising:

a frame;

a plurality of hammers operatively connected with said frame, each of said hammers moveable between a raised position and a lowered position; and at least two independently controlled lift mechanisms associated with said plurality of hammers including a lift means for moving said hammers from said lowered position to said raised position, wherein said lift means includes a lift cylinder and a yoke pivotally connected with said lift cylinder, said yoke further connected with said hammers.

17. A method of breaking a substrate comprising:

providing a substrate breaking apparatus having a first set of laterally spaced hammers and a second set of laterally spaced hammers, said second set being spaced forwardly and laterally offset from said first set, with at least one of the hammers in said second set being positioned laterally between two adjacent hammers in said first set, each of said hammers being moveable between a lowered position and a raised position and repeatedly lifting each of said hammers from said lowered position to said raised position and dropping each of said hammers from said raised position to said lowered position, wherein the timing of said lifting and dropping steps of said plurality of hammers is staggered.

18. The method of claim 17 including lifting each of said hammers with a lift cylinder.

19. The method of claim 17 wherein said plurality of laterally spaced hammers includes at least one pair of hammers and wherein said method includes repeatably lifting said pair of hammers in unison.

20. A method of breaking a substrate comprising:

providing a substrate breaking apparatus having a plurality of laterally spaced hammers, an independently controlled fluid powered lift mechanism operatively connected with each of said hammers and an independent control operatively connected with each lift mechanism, each said control including an adjustable first input means for controlling the raising of said lift mechanism and each of said hammers being moveable between a lowered position and a raised position;

adjusting said first input means to define a preselected raised position for each of said lift mechanisms and thus its operatively connected hammer; and repeatedly lifting each of said hammers from said lowered position to its preselected raised position and dropping each of said hammers from said preselected raised position to said lowered position.

21. A substrate breaking apparatus moveable in a forward direction comprising:

a frame;

a plurality of hammers operatively connected with said frame, each of said hammers moveable between a raised position and a lowered position, said plurality of hammers being in first and second rows each of which extends laterally in a direction perpendicular to said forward direction, at least one of said rows including a plurality of laterally spaced, adjacent hammers and the other of said rows including at least one hammer laterally offset from, and positioned laterally between adjacent hammers in said one row; and lift mechanisms associated with said plurality of hammers.

* * * * *